US007117875B2

(12) United States Patent
Bourjal

(10) Patent No.: US 7,117,875 B2
(45) Date of Patent: Oct. 10, 2006

(54) ASSEMBLY FOR PACKAGING AND APPLICATION OF A PRODUCT, IN PARTICULAR A MAKE-UP PRODUCT

(75) Inventor: Laure Bourjal, Clichy (FR)

(73) Assignee: L'Oreal, Paris (FR)

( * ) Notice: Subject to any disclaimer, the term of this patent is extended or adjusted under 35 U.S.C. 154(b) by 345 days.

(21) Appl. No.: 10/350,125

(22) Filed: Jan. 24, 2003

(65) Prior Publication Data

US 2003/0154996 A1 Aug. 21, 2003

(30) Foreign Application Priority Data

Jan. 25, 2002 (FR) ..... 02 00935

(51) Int. Cl.
*A45D 33/24* (2006.01)
*A45D 33/26* (2006.01)

(52) U.S. Cl. ..... 132/294; 132/295

(58) Field of Classification Search ..... 132/294, 132/295, 296, 297, 317, 318; 206/581, 823; 401/191

See application file for complete search history.

(56) References Cited

U.S. PATENT DOCUMENTS 2,143,061 A * 1/1939 Eastley ..... 132/318
5,031,647 A 7/1991 Seidler
5,348,031 A * 9/1994 Cloud ..... 132/317
6,073,634 A 6/2000 Gueret
6,237,612 B1 * 5/2001 Heyer ..... 132/294
6,298,863 B1 10/2001 Byun

FOREIGN PATENT DOCUMENTS

| | | |
|---|---|---|
| DE | 8901874 | 5/1989 |
| DE | 89 01 874 | 5/1989 |
| EP | 0 960 582 | 12/1999 |
| FR | 2 584 582 | 1/1987 |
| JP | A S62-134503 | 8/1987 |
| JP | A-S63-0689914 | 5/1988 |
| JP | A H01-043814 | 3/1989 |
| JP | A H04-108020 | 9/1992 |

* cited by examiner

*Primary Examiner*—John J. Wilson
*Assistant Examiner*—Robyn Doan
(74) *Attorney, Agent, or Firm*—Oblon, Spivak, McClelland, Maier & Neustadt, P.C.

(57) ABSTRACT

A case that can be used, for example, for a cosmetic product is provided which includes a base having at least one compartment for containing at least one product and a lid for closing the case. At least one applicator is provided for applying the product, with the applicator being releasably connectable to either the base or the lid, and with the other of the base or lid having a locking element which can interact with complementary locking element in order to releasably lock the case in the closed position. Further, the complementary component provided in the at least one applicator.

82 Claims, 3 Drawing Sheets

Fig. 2B
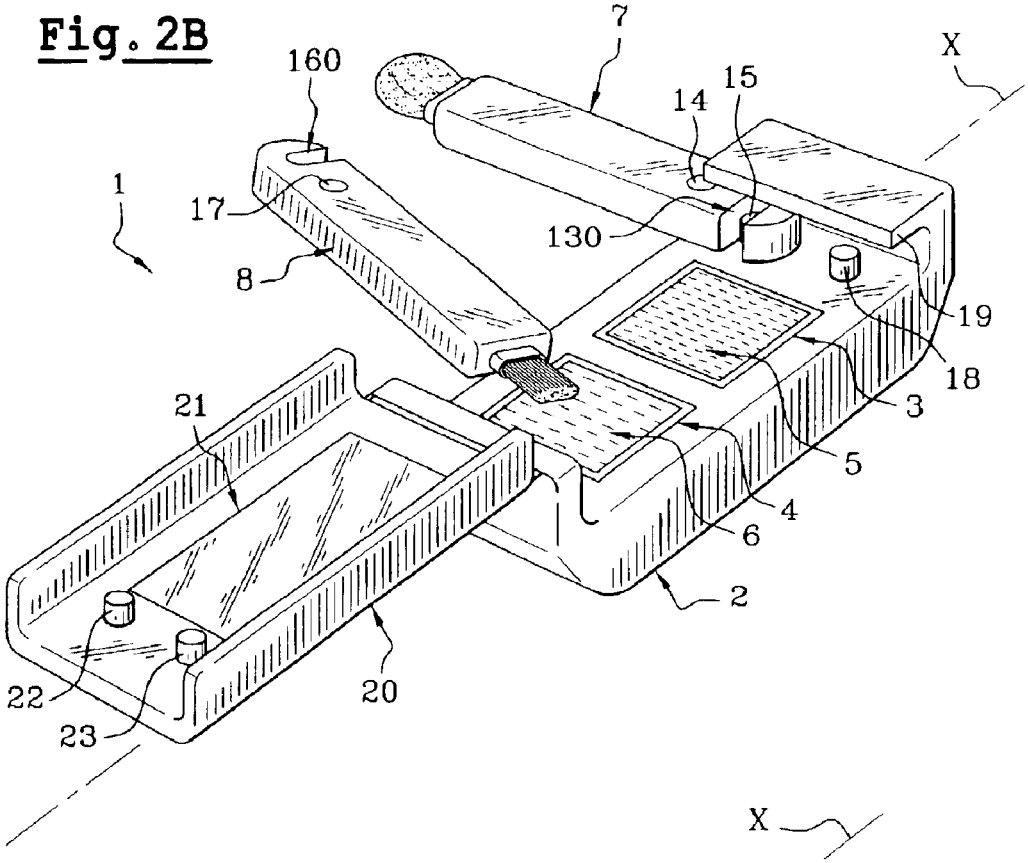
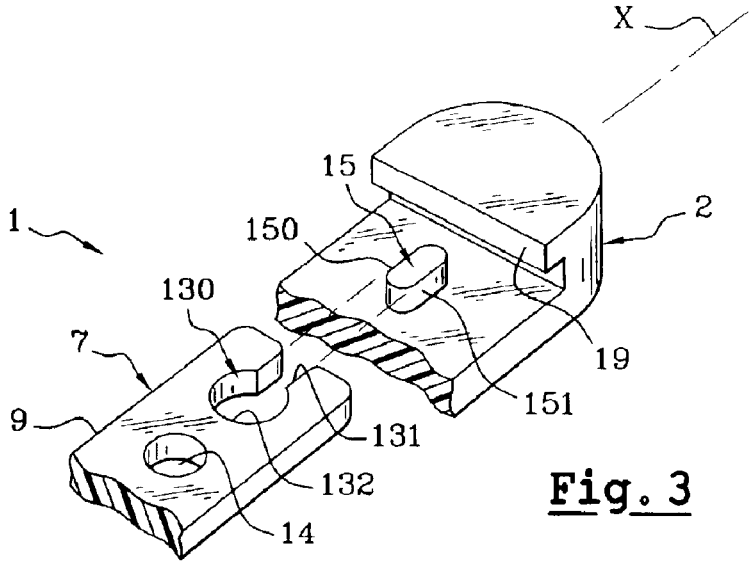
Fig. 3

ASSEMBLY FOR PACKAGING AND APPLICATION OF A PRODUCT, IN PARTICULAR A MAKE-UP PRODUCT

CROSS REFERENCE TO RELATED APPLICATIONS

This document claims priority to French application number 0200935 filed Jan. 25, 2002, the entire content of which is hereby incorporated by reference.

FIELD OF THE INVENTION

The invention relates to cases, such as cases used in the field of cosmetics for the packaging and application of certain make-up or care products, such as eyeshadows, blushers, lipsticks, mascaras or foundations.

BACKGROUND OF THE INVENTION

DISCUSSION OF BACKGROUND

In general, cosmetic or make-up products are applied either with an applicator or directly with the fingers. If the product is applied directly using the fingers, the consumer must have a tap nearby in order to wash their hands after application. Conventional applicators can also be inconvenient because, due to their relatively small size, the applicator is sometimes difficult to find, especially in a handbag. The applicator also needs to be protected against dust or other dirt present in the handbag. Moreover, the applicator (or residual product on it) must not soil the contents of the handbag. For all these reasons, the applicator is often protected inside a compartment or case, which is either separate or which forms part of an assembly for packaging the product to be applied. Where the applicator is provided in a case, the applicator is very small so as not to increase the size of the case inordinately, but such small applicators are typically difficult to handle.

In many of the make-up cases commonly used in the field of cosmetics, a recess is arranged facing the product receptacle, and this recess contains one or more removable applicators which the user employs to take a dose of product before applying it to the desired location. Such an applicator generally includes an application component, for instance a tuft of fibres or bristles, or a tip made of foam or of a woven or nonwoven material. In addition, the applicator component can be optionally covered with a flocking.

Make-up cases that have an associated applicator are described, for example, in FR-A-2 584 582. However, the make-up cases described in this document have a major drawback due to the fact that the user may forget to put the applicator back inside the case after using it. If the applicator is forgotten or lost, the next time the product is to be used, the applicator is not available for applying the product.

The arrangement of EP-0 960 582 attempted to solve the above problem by configuring the lid so that part of the lid is formed by the handle of the applicator. In theory, it is hence impossible to close the case without first putting the applicator back in place on the lid. The case is locked in the closed position by interaction between part of the handle and a corresponding part of the base of the case. A major drawback of this configuration comes from the fact that it requires a relatively wide applicator (typically as wide as the case), and a relatively short handle, since the handle can have only a fraction of the length of the case. The length of the handle typically corresponds to half the axial length of the case. Especially in the field of make-up, however, long thin applicators are preferable for improved make-up control and better gripping of the applicator.

A similar problem arises in a configuration as described in U.S. Pat. No. 6,073,634.

U.S. Pat. No. 5,031,647 describes a sample applicator for a cosmetic product. The configuration described in this document poses problems, especially when handling the applicator, because it is formed by two articulated parts. However, this articulated arrangement hampers controlled application of the product.

DE-A-89 01 874 describes a case having a support on which a cosmetic product is provided. This case has a lid pivotably mounted on the support. The support is intended to store an applicator in a recess. In order to move the lid from a closed position, in which the lid covers the support, to an open position to access the product, the lid is rotated relative to the support. This type of case poses a problem because the lid can be opened inadvertently since the closed position is not locked. Furthermore, part of the applicator is accessible from an upper face of the support when in the closed position, and creates a lever arm which can press the lid in a direction counter to the allowed rotational movement.

SUMMARY OF THE INVENTION

It is, therefore, an object of the invention to produce a packaging and application assembly in the form of a case which solves all or some of the problems discussed above.

It is, in particular, an object of the invention to provide a case in which the risks of misplacing the applicator are substantially reduced.

It is another object of the invention to provide a case which includes an applicator that is easy to manipulate, and allows improved accuracy in applying the product.

It is yet another object of the invention to produce such a case which has an innovative design, which is economical to produce, and which is simple to use.

Other objects will also become apparent from the detailed description herein.

According to the invention, all or some of these objects are achieved by a case, such as a case for a cosmetic product. The case includes a base having at least one compartment intended to contain at least one product. The case further includes a lid for closing the case, with the lid being movable relative to the base. In addition, the case includes at least one applicator for applying the product. The applicator is releasably connectable to the base or the lid, with the other of the base or the lid having a locking element or component which can interact with a complementary locking element or component in order to releasably lock the case in the closed position. The complementary component is provided on the applicator, with the applicator contained inside the case when the lid is locked or mounted in position on the base. In accordance with this arrangement, and contrary to the aforementioned Application EP-0 960 582, the applicator is not involved in forming any part of the element (lid or base) to which it is intended to be coupled, with the lid and base being independent of the applicator.

In accordance with a preferred configuration of the case according to the invention, substantially no limitation is imposed (apart from the constraints naturally imposed by the very nature of the object, and by the conditions in which it is used) regarding the length of the at least one applicator, or regarding how thin they are. The length of the at least one applicator can be, e.g., similar to that of the case, and the width may be chosen as desired.

Since the case is locked in the closed position by engaging the lid (or the base) with the at least one applicator, it is virtually impossible to forget to put the applicator back in place inside the case, since the base could not otherwise be closed correctly.

The closed position of the case corresponds to a position in which the lid is folded fully onto the base, and in which the lid hence prevents access to the compartments containing the product. At least one applicator needs to be coupled on the base (or the lid) in order for the lid to be locked on the base, and in order for the closed position to be maintained. When the case is opened, the lock element of the case disengages from the complementary component or element provided by the at least one applicator, and the applicator remains secured to the part of the case to which it is releasably coupled.

The at least one applicator is preferably removably coupled to the base of the case. This arrangement is advantageous since it can make a greater area on the inner face of the lid available, for example, in order to provide a mirror. However, it is also possible to connect the at least one applicator to the lid, and to provide a mirror on a portion of the base or to use a smaller mirror on the lid.

Preferably, the applicator is entirely contained inside of the case when the case is closed, however, if a portion of the applicator is exposed when the case is closed, preferably it is not a portion used (or grasped) for opening of the case. Further, the applicator is preferably contained integrally inside the case. The term "contained integrally inside the case" means "inaccessible from outside the case," that is to say "incapable of being used for all or some of the operation required for opening the case."

The lid is preferably articulated on the base. The articulation may be carried out by various expedients including, for example, using a film hinge or by an articulation with an additional pin or hinge. When the case is elongated along an axis X, the articulation is preferably carried out about an axis perpendicular to the longer major axis X. However, the articulation can alternately be carried out about an axis parallel to the major axis X. Preferably, the articulation does not utilize an axis which is orthogonal to a plane formed by the base of the case in which the major axis X is defined. For example, this plane can be defined by an upper face of the base which can be flush with the level of the product provided in the compartment.

In accordance with one example of an embodiment of the invention, the at least one applicator is detachable from the base (or from the lid) by a movement relative to the base (or to the lid) in a direction substantially identical to the direction of the movement of the lid relative to the base when the lock element is being engaged/disengaged with the complementary element of the at least one applicator. In the event the case includes a lid articulated on the base, this direction is substantially perpendicular to the closure plane of the case, that is to say, the plane in which the opening of the compartment or compartments containing the product extends. With this example of a case, the force required for detaching the at least one applicator from the base (or from the lid) is chosen to be greater than the force required for opening the case and disengaging the lock element from the complementary element.

The at least one applicator may be coupled to the base (or to the lid) by an interlocking arrangement or snap-fastening. For example, the applicator or applicators can have a bore in which a corresponding stud protruding from the base (or from the lid) of the case can engage tightly.

Similarly, the locking element of the base (or of the lid) can engage the complementary locking element of the at least one applicator by an interlocking arrangement or snap-fastening. The at least one applicator may thus have a bore with which a corresponding stud protruding from the lid (or from the base) can engage tightly. The bore intended for fastening the at least one applicator on the base (or the lid) can be different from the bore intended for locking the lid (or the base) on the applicator. Alternatively, the same bore may be used, for example, with a bore passing through the full thickness of the handle of the applicator, and the height of each of the studs corresponding substantially to half or less of the thickness of the handle. In this case, however, the stud of the part of the case forming the lock preferably has a cross section which is slightly smaller than the cross section of the stud of the part to which the applicator is coupled, so that the at least one applicator remains secured when the lid is opened. It is to be understood that the positions of the elements could be reversed, for example, with a bore providing the locking element of the lid or base and a stud or projection providing the complementary element of the applicator. The same is also true of the elements for releasably mounting the applicator to the lid or base.

In accordance with another example of an embodiment of the invention, the applicator (or applicators) is fitted on the base (or on the lid) so that it can be detached by movement relative to the base (or to the lid) in a direction other than the direction of the movement of the lid relative to the base when the locking element of the lid (or of the base) is being engaged with or disengaged from the complementary component of the applicator. The movement for detaching the applicator from the base (or from the lid) can be, for example, a movement in a direction perpendicular to the direction of the movement of the lid relative to the base when the locking element of the lid (or of the base) is being engaged with the complementary component of the applicator.

Preferably, the movement for detaching the applicator from the base (or from the lid) is a movement in a direction parallel to an axis about which the lid is articulated on the base. Alternatively, the movement for detaching the applicator from the base (or from the lid) is a movement in a direction perpendicular to an axis about which the lid is articulated on the base.

Advantageously, when coupled to the base, the applicator (or applicators) can pass from a first position, in which it is possible to engage the lock of the lid with the complementary component of the applicator to lock the case in the closed position, to a second position in which engagement is not possible. For example, in the first position, at least part of the applicator can at least partly cover the product compartment or compartments, and the applicator can uncover or be spaced away from the compartment or compartments in the second position. Preferably, with this arrangement, the movement for detaching the applicator from the base is possible when the applicator is in the first position. The movement from the first position to the second position, and vice versa, can be, for example, a pivoting movement about an axis perpendicular to a plane containing an opening of the compartment or compartments of the base.

The case can include one or plural applicators. By way of example, where the case includes two applicators, the user extracts the applicator which she wishes to use, and pivots the other one so as to free access to the compartment containing the product to be taken. The user then applies the product using the first applicator. After applying the product, the user can put the first applicator back in place and extract the second one, either in order to apply a product contained in a separate compartment or in order to tone, smooth or blend in the product applied using the first applicator.

Preferably, the case according to the invention has a mirror, preferably on an inner face of the lid.

As mentioned above, the case can have two (or more) applicators, with both applicators being releasably connectable to the base (or to the lid) and each having a complementary which can interact with a corresponding lock of the lid (or of the base) to releasably lock the case in the closed position. Alternatively, it is possible to use only one applicator for locking the lid on the base.

As a further alternative, the lid can have a first locking element or component intended to interact with a complementary component which is provided by a first applicator removably coupled to the base, whereas the base has a second locking element intended to interact with a complementary component which is formed by a second applicator removably coupled to the lid. This holding arrangement can be more symmetrical and therefore of better quality or perception. Upon opening, the lid is separated from the base, one of the applicators remains secured to the base, and the other applicator is secured to the lid.

The product or products may be contained in one or more cups arranged in one or more compartments delimited by the base. The product may be poured into the cups while cold or hot, or it may be compacted. The product may also be disposed directly on or in a compartment delimited by the base.

When the case has a shape which is elongated along an axis X, the at least one applicator is preferably orientated along the axis X.

The applicator(s) can have a handle, for example, a flat handle, with an application component formed at an end. The application component can be, for example, a fine brush, a block of foam, a thick brush, a felt or other material, or an element made of an elastomeric material.

BRIEF DESCRIPTION OF THE DRAWINGS

A better appreciation of the invention and many of the attendant advantages thereof will become further apparent from the following detailed description, particularly when read in conjunction with the accompanying drawings in which:

FIGS. 2A and 2B are perspective views of a second embodiment of a case according to the invention; and FIG. 3 represents a detail view of a portion of a case according to the invention to illustrate a variation of the second embodiment.

DETAILED DESCRIPTION OF THE PREFERRED EMBODIMENTS

Figure 1:
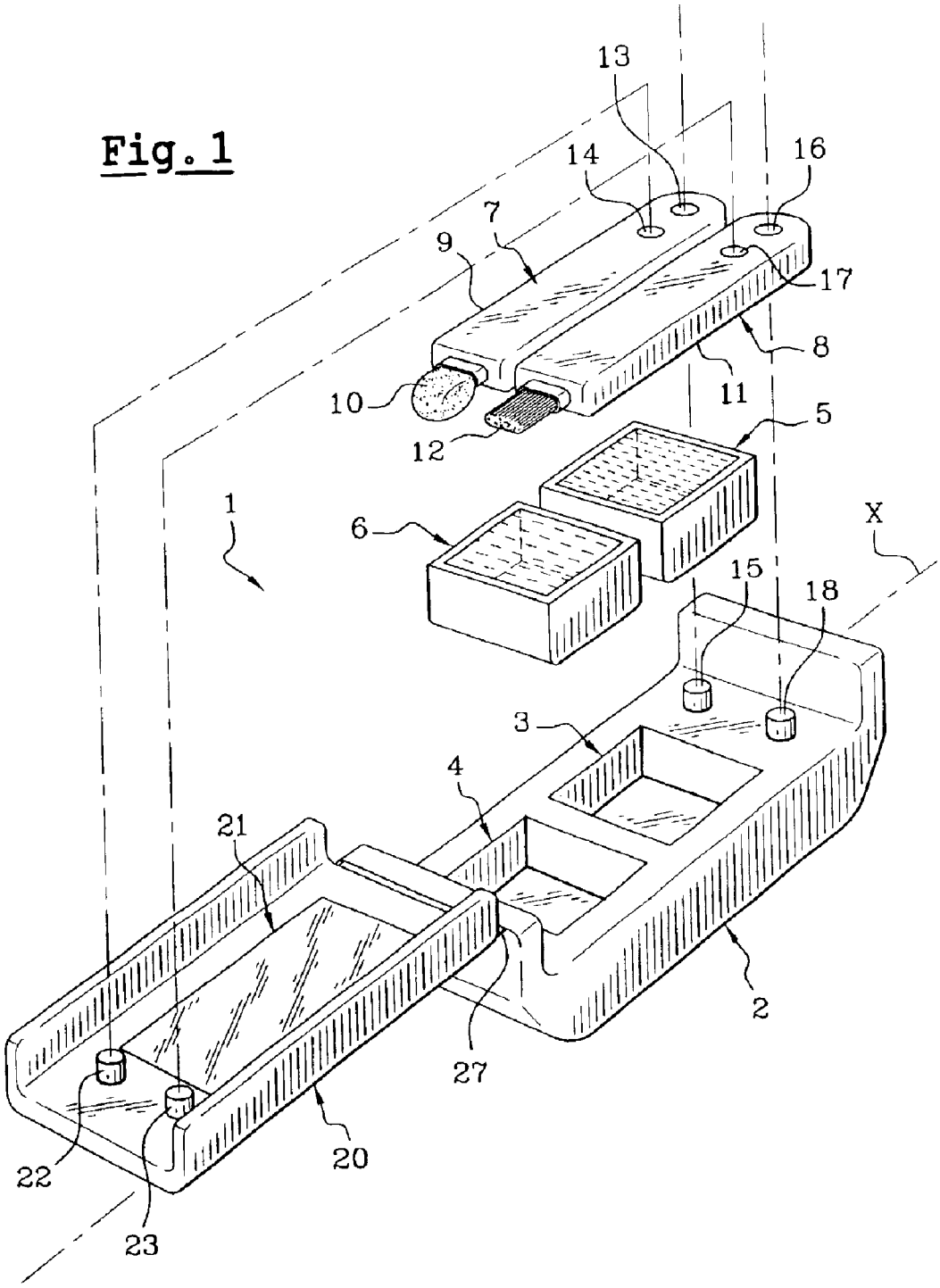
FIG. 1 is an exploded perspective view illustrating a first embodiment of a case according to the invention.

According to the embodiment represented in FIG. 1, the case has a shape which is elongated along an axis X. The case includes a base 2 delimiting two compartments 3 and 4. The compartment 3 is intended to accommodate a cup 5 containing an eyeshadow. The compartment 4 is intended to accommodate a cup 6 containing a blusher. However, as noted earlier, the product could also be disposed on or within the base without requiring a separate cup.

A lid 20 is articulated on the base 2 via a film hinge 27. A mirror 21 can also be adhesively bonded on the inner surface of the lid 20.

The case illustrated also includes two applicators 7 and 8. The applicator 7 includes a flat handle 9, at whose end a block of flocked foam 10 is fixed. The applicator 7 is intended for applying the eyeshadow contained in the cup 5. The applicator 8 includes a flat handle 11, at whose end a fine brush 12 is fixed. The applicator 8 is intended for applying the blusher contained in the cup 6.

In the vicinity of its end on the other side from the block of foam 10, the handle 9 of the applicator 7 is pierced by two holes 13 and 14. As shown, the holes 13, 14 are preferably aligned along the longitudinal axis of the applicator 7. The first hole 13 is intended to tightly receive a stud or projection 15. In the illustrated embodiment, the stud or projection is provided on the base 2 in the vicinity of its end remote from the film hinge 27, hence reversibly fastening the applicator 7 on the base 2 of the case. The second hole 14 is intended to tightly receive a stud or projection 22 which in the illustrated embodiment is provided on the inner surface of the lid 20 in the vicinity of its end remote from the film hinge 27, hence contributing to the locking of the lid 20 on the base 2, and therefore to the releasable closure of the case. The force with which the applicator 7 is held on the base 2 is greater than the force with which the lid 20 is held to the applicator 7.

In the vicinity of its end remote from the fine brush 12, the handle 11 of the applicator 8 is pierced by two holes 16, 17. As with the applicator 7, the holes 16, 17 of applicator 8 are preferably aligned along the longitudinal axis of the applicator 8. The first hole 16 is intended to tightly receive a stud 18 which is provided on the base 2 in the vicinity of its end remote from the film hinge 27, hence reversibly fastening the applicator 8 on the base 2 of the case. The studs or projections 15 and 18 are preferably arranged along an axis parallel to the axis of the film hinge 27. The second hole 17 is intended to tightly receive a stud 23 which is provided on the inner surface of the lid 20 in the vicinity of its end remote from the film hinge 27, hence completing the locking of the lid 20 on the base 2, which is also partly provided by the stud 22 with the hole 14 of the applicator 7. The force with which the applicator 8 is held on the base 2 is greater than the force with which the lid 20 is held to the applicator 8.

In the illustrated embodiment, when the applicators 7 and 8 are fitted in position on the base 2, they extend at least partly over the compartments 3 and 4. For use, the consumer disengages the studs 22 and 23 from the respective bores 14 and 17 of the applicators 7 and 8. Since the applicators 7 and 8 are held on the base 2 more strongly than the lid 20 is held on the applicators 7 and 8, the applicators remain secured to the base 2. The user then pivots the lid 20 about the axis defined by the film hinge 27.

If the user wants to apply some eyeshadow, she disengages the stud 15 from the bore 13 so as to release the applicator 7. She then pivots the applicator 8 about the stud 18 so as to obtain full access to the compartments 3 and 4. She then applies the product conventionally by means of the applicator 7, while making use of the mirror 21 provided on the inner face of the lid 20. The user then puts the applicator 7 back in position on the stud 15.

If the user subsequently wants to apply some blush, she disengages the stud 18 from the bore 16 so as to release the applicator 8. She then pivots the applicator 7 about the stud 15 so as to obtain full access to the compartments 3 and 4. The user then conventionally applies the product by means of the applicator 8. Alternatively, the user could use the applicator 8 before replacing the applicator 7. After use, the user puts both applicators 7 and 8 correctly back on the base 2, orienting them along the longitudinal axis X.

The user closes the lid by pivoting it about the axis 27 in the opposite direction to the opening movement, until the studs 22 and 23 engage respectively with the bores 14 and 17 of the applicators 7 and 8. The case is then closed and locked and can be put back in the user's handbag until use is desired again.

Figure 2A:
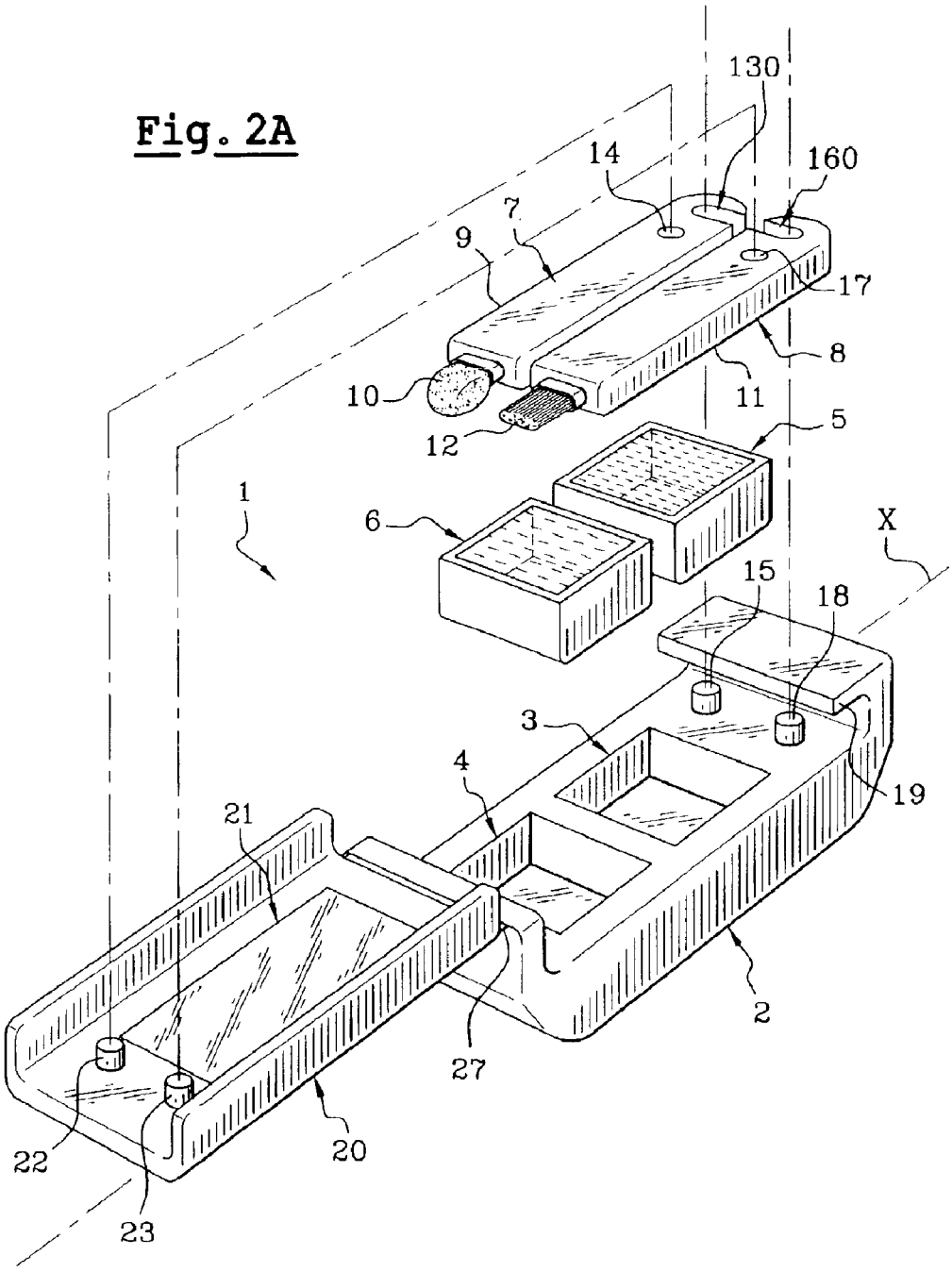

The embodiment in FIGS. 2A and 2B differs from the previous embodiment essentially by the way in which the applicators 7 and 8 are coupled on the base 2. Specifically, the apertures in the form of bores 13 and 16 of the previous embodiment are replaced by apertures in the form of notches 130 and 160, which are open on respective inner side edges of the applicators 7 and 8. With the arrangement illustrated in FIGS. 2A and 2B, the applicators 7 and 8 are hence fitted or mounted onto the base by moving the applicators 7 and 8 in a direction perpendicular to their longitudinal axis and parallel to the hinge 27, in the plane of the openings delimited respectively by the compartments 3 and 4, until the studs 15 and 18 come into contact with the base of the notches 130 and 160, respectively. Removal is carried out by moving the applicators 7 and 8 in the opposite direction relative to the base 2.

When the applicators 7 and 8 of FIG. 2A are mounted, they are aligned with the longitudinal axis X of the case, and the applicators cannot be separated from the base by movement in a direction perpendicular to the plane of the handles 9 and 11, respectively, since at its end remote from the hinge 27 the base 2 preferably forms a lip 19 preventing such movement. There is hence no risk of the applicators 7 and 8 being detached from the base 2 when the case 1 is opened. The same is true when the applicators 7 and 8 of FIG. 2A are not oriented along the longitudinal axis X of the case. This is because when an applicator 7 is pivoted about the stud 15 in order to allow access to the compartments 3 and 4 by the other applicator 8, the applicator 7 cannot be detached from the base 2 owing to the presence of the lip 19 and the orientation of the notch 130, and in particular of its opening relative to the base 2. This is illustrated very clearly in FIG. 2B. As discussed earlier, a different number of applicators could be provided, for example, one applicator or more than two applicators.

Other than the features discussed above, the use of the case according to the embodiment of FIGS. 2A and 2B is identical to that which was described with reference to the embodiment of FIG. 1. Repetitive details are therefore omitted.

The embodiments discussed above are intended as examples as it is to be understood that various modifications are possible, for example, relating to the size, shape or position of various elements. FIG. 3 illustrates a variation of the embodiment of FIGS. 2A and 2B in which only a single applicator 7 is provided. In this arrangement, the stud 15 has two truncated (flat) side edges 150 and 151. The notch 130 does not open laterally as in the embodiment in FIGS. 2A and 2B, but instead opens axially via an entry/exit passage 131. The passage 131 has a width that is slightly greater than the distance between the two truncated edges 150 and 151 of the stud 15, but less than the width of the stud 15 along its longer (major) axis. The entry/exit passage 131 is followed by a substantially circular portion 132 whose diameter is slightly greater than the longest dimension of the stud 15. The applicator can hence be fitted on the base only by an axial movement parallel to the plane of its handle 9 due to the shape of the entry/exit passage 131 in relation to the shape of the stud 15, and due to the presence of the lip 19 formed by the base. Once fitted, however, the applicator 7 can pivot about the stud 15 in the manner represented in FIG. 2B. With this configuration there is no risk of the applicator 7 being detached from the base 2 when the case 1 is opened. The same is true when the applicator 7 is not oriented along the longitudinal axis X of the case.

Other than the features discussed above, the operation of a case 1 configured according to the variant in FIG. 3 is identical to the operation of the embodiment represented in FIGS. 2A and 2B. Repetitive details are therefore omitted.

Obviously, numerous modifications and variations of the present invention are possible in light of the above teachings. It is therefore to be understood that, within the scope of the appended claims, the invention may be practiced otherwise than as specifically described herein.

What is claimed is:

1. A case for a product comprising:

a base having at least one compartment for containing at least one product;

a lid which is movable relative to the base to open and close the case, wherein said lid is movable between a closed position and an open position and wherein when said lid is in the closed position a further compartment is defined between said lid and said base; and at least one applicator for applying the product said at least one applicator including a handle and at least one application component which holds a product for application;

wherein the said at least one applicator is releasably connectable to one of said base and said lid, and wherein the other of said base and said lid has locking means which interact with complementary means in order to releasably lock the case in the closed position, and wherein the at least one applicator includes said complementary means such that when the at least one applicator is inside of the case, the case can be locked in said closed position by interaction of said locking means of the other of said base and said lid and said complementary means of said at least one applicator, and further wherein when said applicator is inside said case and said case is locked in said closed position said applicator is disposed inside of said further compartment defined between said lid and said base, and wherein when said lid is moved from said closed position to said open position said at least one applicator is retained on said one of said base and said lid with said application component exposed.

2. A case as recited in claim 1, wherein the lid is mounted to said base with an articulated mount.

3. A case as recited in claim 1, wherein the lid is movably mounted to the base with an articulated mount having an articulation axis which is not orthogonal to a plane formed by the base.

4. A case as recited in claim 1, wherein the at least one applicator needs to be coupled to the one of said base and said lid in order for the case to be locked in the closed position by interaction of said locking means and said complementary means.

5. A case as recited in claim 1, wherein the at least one applicator can be detached from the one of said base and said lid to which the at least one applicator is releasably connectable by moving the at least one applicator in a substantially same direction as a direction of initial movement of the lid relative to the base upon opening of the case.

6. A case as recited in claim 5, wherein a force required for detaching the at least one applicator from the one of said base and said lid is greater than a force required for uncoupling said locking means and said complementary means to open said case.

7. A case as recited in claim 5, wherein the at least one applicator is releasably connectable to the one of said base and said lid by one of an interlocking fastening arrangement and a snap-fastening arrangement.

8. A case as recited in claim 7, wherein the locking means engage with the complementary means of the at least one applicator by one of an interlocking fastening arrangement and a snap-fastening arrangement.

9. A case as recited in claim 1, wherein the locking means engage with the complementary means of the at least one applicator by a snap-fastening arrangement.

10. A case as recited in claim 1, wherein the at least one applicator is releasably connected to the one of said base and said lid so as to be detached only by a movement relative to the one of said base and said lid in a direction other than a direction of the movement of the lid relative to the base associated with opening said case.

11. A case as recited in claim 10, wherein movement for detaching the said at least one applicator from the one of said base and said lid is a movement in a direction perpendicular to a direction of the movement of the lid relative to the base associated with opening of said case.

12. A case as recited in claim 11, wherein the movement for detaching the said at least one applicator from the one of said base and said lid is a movement in a direction parallel to an axis about which the lid is articulated on the base.

13. A case as recited in claim 11, wherein the movement for detaching the said at least one applicator from the one of said base and said lid is a movement in a direction perpendicular to an axis about which the lid is articulated on the base.

14. A case for a product comprising:

a base having at least one compartment for containing at least one product;

a lid which is movable relative to the base to open and close the case; and at least one applicator for applying the product;

wherein the said at least one applicator is releasably connectable to one of said base and said lid, and wherein the other of said base and said lid has locking means which interact with complementary means in order to releasably lock the case in a closed position, and wherein the at least one applicator includes said complementary means such that when the at least one applicator is inside of the case, the case can be locked by interaction of said locking means of the other of said base and said lid and said complementary means of said at least one applicator; and wherein the at one least applicator is releasably connectable to the base and when the at least one applicator is connected to the base it is movable between at least a first position and a second position, and wherein in said first position the locking means can lock with the complementary means of the at least one applicator to lock the case in the closed position, and wherein in said second position the locking means will not lock with the complementary means.

15. A case as recited in claim 14, wherein in the first position at least part of the at least one applicator at least partly covers the at least one compartment, and wherein in the second position the said at least one applicator does not cover the at least one compartment.

16. A case as recited in claim 14, wherein a movement for detaching the at least one applicator from the base is possible when the at least one applicator is in the first position.

17. A case as recited in claim 16, wherein the at least one applicator cannot be detached from said base when the at least one applicator is in the second position.

18. A case as recited in claim 14, wherein movement of the at least one applicator between said first position and said second position is a pivoting movement about an axis perpendicular to a plane containing an opening of the at least one compartment of the base.

19. A case as recited in claim 1, further including a mirror.

20. A case as recited in claim 19, wherein said mirror is disposed on an inner face of said lid.

21. A case for a product comprising:

a base having at least one compartment for containing at least one product;

a lid which is movable relative to the base to open and close the case; and at least one applicator for applying the product;

wherein the said at least one applicator is releasably connectable to one of said base and said lid, and wherein the other of said base and said lid has locking means which interact with complementary means in order to releasably lock the case in a closed position, and wherein the at least one applicator includes said complementary means such that when the at least one applicator is inside of the case, the case can be locked by interaction of said locking means of the other of said base and said lid and said complementary means of said at least one applicator; and wherein said at least one applicator includes two applicators.

22. A case as recited in claim 21, wherein each of the two applicators is releasably connectable to the one of said base and said lid, and each has a complementary means which can interact with a corresponding locking means of the other of said base and said lid to releasably lock the case in a closed position.

23. A case as recited in claim 21, wherein a first of said applicators is releasably connectable to the base and the lid has a first locking means which interacts with a first complementary means of the said first applicator.

24. A case as recited in claim 23, wherein a second applicator is releasably connectable to the lid and the base has a second locking means which can interact with a second complementary means of said second applicator.

25. A case as recited in claim 1, wherein the case has a shape which is elongated along an axis X, and wherein the at least one applicator is oriented along said axis X when the case is in the closed position.

26. A case as recited in claim 1, wherein said application component includes at least one of a fine brush, a block of foam, a thick brush, a felt, and an element made of elastomeric material.

27. A case as recited in claim 1, wherein said at least one compartment contains a cosmetic.

28. A case as recited in claim 27, wherein said cosmetic is an eyeshadow.

29. A case as recited in claim 27, wherein said cosmetic is a blush.

30. A case as recited in claim 1, wherein said base includes at least two compartments, and wherein each of said two compartments contains a cosmetic.

31. A case as recited in claim 30, wherein said at least one applicator includes two applicators, and wherein each of the at least two applicators is releasably connected to one of said base and said lid.

32. A case as recited in claim 31, wherein each of said two applicators is releasably connectable to a same one of said base and said lid.

33. A case for a product comprising:

a base having at least one compartment for containing at least one product;

a lid which is movable relative to the base to open and close the case; and at least one applicator for applying the product;

wherein the said at least one applicator is releasably connectable to one of said base and said lid, and wherein the other of said base and said lid has locking means which interact with complementary means in order to releasably lock the case in a closed position, and wherein the at least one applicator includes said complementary means such that when the at least one applicator is inside of the case, the case can be locked by interaction of said locking means of the other of said base and said lid and said complementary means of said at least one applicator;

wherein said base includes at least two compartments, and wherein each of said two compartments contains a cosmetic;

wherein said at least one applicator includes two applicators, and wherein each of the at least two applicators is releasably connected to one of said base and said lid;

wherein each of said two applicators is releasably connectable to a same one of said base and said lid; and wherein each of said two applicators is pivotably movable when connected to said one of said base and said lid.

34. A case as recited in claim 33, wherein each of said two applicators is pivotably movable between a position at least partly covering at least one of said compartments and a position not covering said two compartments.

35. A case as recited in claim 34, wherein one of said at least two compartments contains a blush and another of said at least two compartments contains an eyeshadow.

36. A case as recited in claim 1, wherein the at least one applicator is entirely enclosed inside the further compartment of said case when the case is closed and locked.

37. A case for containing a product and an applicator, said case comprising:

a base, said base including a compartment for containing a product;

a lid movably mounted to said base to open and close said case, wherein a further compartment is defined between said base and said lid when said lid is in a closed position;

an applicator said applicator including a handle and an application component which holds a product for application;

means for removably mounting said applicator to one of said base and said lid, and wherein said applicator is disposed inside of said further compartment when said applicator is mounted to said one of said base and said lid and said case is in said closed position, and further wherein when said applicator is disposed in said further compartment and said case is in said closed position said lid extends over the entire handle and application component of said applicator; and means for releasably locking the other of said base and said lid to said applicator to lock said case in said closed position when said lid is closed and said applicator is in said further compartment.

38. A case as recited in claim 37, wherein said means for removably mounting said applicator holds said applicator mounted to said one of said base and said lid during release of said means for releasably locking such that said applicator remains mounted upon opening of said case.

39. A case as recited in claim 38, wherein said means for removably mounting pivotably mounts said applicator such that said applicator can pivot when mounted to said one of said base and said lid.

40. A case for containing a product and an applicator, said case comprising:

a base, said base including a compartment for containing a product;

a lid movably mounted to said base to open and close said case;

an applicator;

means for removably mounting said applicator to one of said base and said lid, and wherein said applicator is disposed inside of said case when said applicator is mounted to said one of said base and said lid and said case is closed;

means for releasably locking the other of said base and said lid to said applicator to lock said case in said closed position; and wherein said means for removably mounting pivotably mounts said applicator such that said applicator can pivot when mounted to said one of said base and said lid.

41. A case as recited in claim 40, wherein said applicator can pivot between at least a first position and a second position, and wherein said means for releasably locking can lock the other of said base and said lid to said applicator when said applicator is in said first position but not when said applicator is in said second position.

42. A case as recited in claim 41, wherein said applicator at least partly covers said compartment in said first position.

43. A case as recited in claim 42, wherein said compartment contains a cosmetic.

44. A case as recited in claim 43, wherein said base includes two compartments, each containing a cosmetic.

45. A case as recited in claim 44, wherein one of said compartments contains an eyeshadow and another of said compartments contains a blush.

46. A case as recited in claim 44, further including a second applicator.

47. A case as recited in claim 37, further including a second applicator.

48. A case as recited in claim 47, further including second means for removably mounting said second applicator to one of said base and said lid.

49. A case for containing a product and an applicator, said case comprising:

a base, said base including a compartment for containing a product;

a lid movably mounted to said base to open and close said case;

an applicator;

means for removably mounting said applicator to one of said base and said lid, and wherein said applicator is disposed inside of said case when said applicator is mounted to said one of said base and said lid and said case is closed;

means for releasably locking the other of said base and said lid to said applicator to lock said case in said closed position;

the case further including a second applicator, second means for removably mounting said second applicator to one of said base and said lid, and second locking means for releasably locking the other of said base and said lid to said second applicator to lock said case in said closed position.

50. A case as recited in claim 49, wherein said base includes two compartments with each containing a cosmetic.

51. A case for containing a cosmetic product and an applicator comprising:

a base which holds a cosmetic product;

a lid which is movable relative to said base between open and closed positions, wherein when said lid is in said closed position a compartment is defined between said lid and said base;

at least one applicator removably mounted on one of said base and said lid, said at least one applicator including a handle and at least one application component which holds a product for application;

a locking element provided on the other of said base and said lid; and a complementary locking element disposed on said applicator, wherein said locking element engages with said complementary locking element when said at least one applicator is mounted on said one of said base and said lid and said case is closed to lock said ease in said closed position, and further wherein when said case is closed and said at least one applicator is mounted on said one of said base and said lid said at least one applicator is contained inside of said compartment, and wherein when said lid is moved from said closed position to said open position said at least one applicator is retained on said one of said base and said lid with said application component exposed.

52. A case as recited in claim 51, wherein said at least one applicator includes two applicators and wherein a complementary locking element is provided on each of said two applicators and a respective locking element is provided for engaging each of said complementary locking elements when said case is closed.

53. A case as recited in claim 52, wherein said two applicators are both removably mounted on a same one of said base and said lid.

54. A case as recited in claim 53, wherein said base holds two cosmetic products.

55. A case as recited in claim 54, wherein one of said cosmetic products is an eyeshadow and another of said cosmetic products is a blush.

56. A case as recited in claim 51, wherein said one of said base and said lid on which said applicator is removably mounted includes a lip to hold said applicator in a mounted position upon opening of said case.

57. A case as recited in claim 51, wherein said applicator is snap-fastened to removably mount said applicator to said one of said base and said lid, and further wherein a force required to decouple said applicator from said one of said base and said lid is greater than a force required to disengage said locking element from said complementary locking element.

58. A case as recited in claim 51, wherein the at least one applicator is entirely enclosed inside the compartment of said case when the case is closed and the locking element engages with the complementary locking element.

59. A case as recited in claim 1, wherein said at least one applicator is releasably connectable to said base, and wherein when said at least one applicator is inside of said further compartment and said case is locked in said closed position said at least one applicator at least partially covers said compartment for containing at least one product and whereby upon opening of said lid said at least one applicator at least partially covers said compartment for containing said at least one product.

60. A case as recited in claim 59, wherein said at least one applicator comprises two applicators each of which partially covers said compartment containing at least one product when said two applicators are disposed in said further compartment and said lid is in the closed position and wherein the two applicators each partially cover said compartment when said lid is initially opened.

61. A case as recited in claim 59, wherein said at least one applicator comprises two applicators, and wherein said base includes two compartments containing at least one product and wherein said two applicators cover said two compartments when said lid is in the closed position and when said lid is initially opened.

62. A case as recited in claim 1, wherein said lid has a width extending in a widthwise direction of the case which is larger than a width of said at least one applicator in said widthwise direction.

63. A case as recited in claim 62, wherein said lid has a length in a lengthwise direction of said case which is larger than the width of said lid, and wherein the length of said lid is larger than a length of said applicator in said lengthwise direction.

64. A case as recited in claim 51, wherein said at least one applicator is releasably connectable to said base, and wherein when said at least one applicator is inside of said compartment and said case is locked in said closed position said at least one applicator at least partially covers a product containing compartment of said base and whereby upon opening of said lid said at least one applicator at least partially covers said product containing compartment.

65. A case as recited in claim 64, wherein said at least one applicator comprises two applicators each of which partially covers said product between said base and said lid and said lid is in the closed position, and wherein the two applicators each partially cover said product containing compartment when said lid is initially opened.

66. A case as recited in claim 64, wherein said at least one applicator comprises two applicators, and wherein said base includes two product containing compartments, and wherein said two applicators cover said two product containing compartments when said lid is in the closed position and when said lid is initially opened.

67. A case as recited in claim 51, wherein said lid has a width extending in a widthwise direction of the case which is larger than a width of said at least one applicator in said widthwise direction.

68. A case as recited in claim 67, wherein said lid has a length in a lengthwise direction of said case which is larger than the width of said lid, and wherein the length of said lid is larger than a length of said applicator in said lengthwise direction.

69. A case as recited in claim 51, wherein said base includes two product containing compartments, and wherein said at least one applicator comprises two applicators removably mounted to said base, and wherein each of said two applicators extend over both of said two product containing compartments when said lid is in said closed position and when said lid is initially opened.

70. A case as recited in claim wherein said applicator is removably mounted on said base, wherein said base includes a surface and wherein a portion recessed from said surface defines a product containing compartment, and wherein the locking element includes one of a projection and a recess on said lid extending in a direction perpendicular to said surface when said lid is in the closed position, and wherein the complementary locking element includes the other of a projection and a recess on said applicator extending in said direction perpendicular to said surface when said applicator is mounted on said base.

71. A case as recited in claim 70, further including one of a further projection and a further recess provided on said base extending in said direction perpendicular to said surface and which engages with the other of a further projection and a further recess provided on said applicator extending in said direction perpendicular to said surface when said applicator is mounted on said base.

72. A case as recited in claim 51, wherein said applicator is removably mounted on said base, and wherein a mirror is disposed on said lid.

73. A case for holding a cosmetic product and an applicator comprising:

a base which includes at least one compartment which holds a cosmetic product;

a lid which is movable relative to said base between open and closed positions;

at least one applicator removably mounted on said base;

a locking element provided on said lid;

a complementary locking element provided on said applicator, wherein said locking element engages with said complementary locking element when said lid is in said closed position to lock the lid in the closed position, and wherein said complementary locking element and said locking element disengage as said lid is moved from said closed position to said open position;

wherein when said applicator is mounted on said base and said lid is in the closed position the applicator at least partially covers said at least one compartment and wherein as the lid is moved from said closed position to said open position said applicator remains mounted on said base such that when said lid is initially opened said applicator at least partially covers said at least one compartment.

74. A case as recited in claim 73, wherein said at least one applicator comprises two applicators each of which partially covers said compartment which holds at least one cosmetic product when said lid is in the closed position, and wherein the two applicators each partially cover said compartment when said lid is initially opened.

75. A case as recited in claim 73, wherein said at least one applicator comprises two applicators, and wherein said base includes two compartments containing at least one cosmetic product and wherein said two applicators cover said two compartments when said lid is in the closed position and when said lid is initially opened.

76. A case as recited in claim 73, wherein said lid has a width extending in a widthwise direction of the case which is larger than a width of said at least one applicator in said widthwise direction.

77. A case as recited in claim 76, wherein said lid has a length in a lengthwise direction of said case which is larger than the width of said lid, and wherein the length of said lid is larger than a length of said applicator in said lengthwise direction.

78. A case according to claim 77, further including a mirror disposed on said lid.

79. A case according to claim 73, wherein when said lid is in said closed position a further compartment is defined between said lid and said base and wherein when said applicator is mounted on said base and said lid is in the closed position said applicator is entirely enclosed in said further compartment.

80. A case according to claim 73, further including means for removably mounting said applicator to said base.

81. A case according to claim 73, further including a mirror disposed on said lid.

82. A case according to claim 73, wherein said lid is pivotably mounted to said base to move about a pivot axis, wherein said pivot axis extends substantially parallel to a surface of said lid, and wherein a mirror is disposed on said surface of said lid.

* * * * *

UNITED STATES PATENT AND TRADEMARK OFFICE

CERTIFICATE OF CORRECTION

PATENT NO. : 7,117,875 B2
APPLICATION NO. : 10/350125
DATED : October 10, 2006
INVENTOR(S) : Laure Bourjal It is certified that error appears in the above-identified patent and that said Letters Patent is hereby corrected as shown below:

In column 14, line 65 after "claim" insert -- 51 --.

Signed and Sealed this

Twenty-second Day of January, 2008

JON W. DUDAS
*Director of the United States Patent and Trademark Office*